US011622605B2

(12) United States Patent
Ben-Arie

(10) Patent No.: US 11,622,605 B2
(45) Date of Patent: Apr. 11, 2023

(54) BUTTON ATTACHMENT BY RESILIENT GATES TRAPPING MECHANISM

(71) Applicant: Jezekiel Ben-Arie, Carlsbad, CA (US)

(72) Inventor: Jezekiel Ben-Arie, Carlsbad, CA (US)

( * ) Notice: Subject to any disclaimer, the term of this patent is extended or adjusted under 35 U.S.C. 154(b) by 0 days.

(21) Appl. No.: 17/522,902

(22) Filed: Nov. 10, 2021

(65) Prior Publication Data

US 2022/0295945 A1 Sep. 22, 2022

Related U.S. Application Data

(63) Continuation-in-part of application No. 17/206,135, filed on Mar. 19, 2021, now Pat. No. 11,219,277.

(51) Int. Cl.
*A44B 1/38* (2006.01)

(52) U.S. Cl.
CPC ..... *A44B 1/38* (2013.01)

(58) Field of Classification Search
CPC ..... A44B 1/38; A44B 1/14; A44B 1/28
See application file for complete search history.

(56) References Cited

U.S. PATENT DOCUMENTS 1,981,813 A * 11/1934 Schuster ..... A44B 1/28 24/706.4
2,671,255 A * 3/1954 Kember ..... A44B 1/28 24/114.4
3,389,439 A * 6/1968 Papazian ..... A44B 1/28 411/525
3,623,192 A * 11/1971 Papazian ..... A44B 1/34 411/510
3,691,597 A * 9/1972 Kahn ..... A44B 1/34 24/108
3,725,980 A * 4/1973 Burgio ..... A44B 1/34 24/108
3,982,013 A * 9/1976 Katsuda ..... C07D 307/42 514/464
4,033,012 A * 7/1977 Kramer ..... A44B 1/28 24/95
4,512,063 A * 4/1985 Fukuroi ..... A44B 1/44 24/94
4,662,034 A * 5/1987 Cunningham ..... A44B 1/28 24/94
4,683,621 A * 8/1987 Watanabe ..... A44B 1/44 24/95

(Continued)

*Primary Examiner* — David M Upchurch

(57) ABSTRACT

A button assembly configured for fast button attachment onto a garment cloth. The assembly comprises a buttoning structure and a retaining structure. The buttoning structure includes a button attached to a spacer attached to a pole attached to a terminal element. The retaining structure comprises a trapping mechanism housed in an aperture with upper opening with a rim attached to a planar plate which is divided into resilient flaps by concentric slits. Attaching the buttoning structure to the garment cloth entails piercing the cloth by the terminal element and inserting it into the retaining structure while bending the flaps. Further insertion releases the flaps which unbend and trap the terminal element inside the retaining structure and preventing its attached button from detachment. Thereby, attaching the button onto the garment cloth. The terminal element could attain a hemispherical or cylindrical shapes. A replaceable ornamental cap fits snugly the button's top.

16 Claims, 6 Drawing Sheets

(56) References Cited

U.S. PATENT DOCUMENTS 4,723,421 A * 2/1988 Nitsche ..... A44C 7/003 63/12
4,751,780 A * 6/1988 Trolltsch ..... B26B 19/044 30/346.51
4,875,257 A * 10/1989 Anderson ..... A44B 1/06 24/114.9
4,928,362 A * 5/1990 Collas ..... A44B 1/08 24/94
5,428,872 A * 7/1995 Papazian ..... A44B 1/28 24/103
5,933,929 A * 8/1999 Kawakami ..... A44B 17/0035 24/324
5,940,940 A * 8/1999 Tanikoshi ..... A44B 17/0082 24/108
5,975,398 A * 11/1999 Evans ..... A41H 37/008 227/71
7,137,176 B2 * 11/2006 Flavio de Macedo ... G09F 3/12 24/104
8,522,404 B2 * 9/2013 Matei ..... A44B 1/28 24/104
8,938,861 B1 * 1/2015 McLendon ..... A44B 1/185 24/103
9,820,520 B2 * 11/2017 Bolen ..... A44B 1/08
10,004,299 B2 * 6/2018 Maussen ..... A41F 1/02
10,455,901 B2 * 10/2019 Marin ..... A44B 1/34
2001/0005924 A1 * 7/2001 Watanabe ..... A44B 1/28 24/94
2005/0121479 A1 * 6/2005 de Macedo ..... G09F 3/0305 223/1
2005/0188510 A1 * 9/2005 Retamal ..... A44B 1/28 24/114.4
2010/0236029 A1 * 9/2010 Mattei ..... A44B 1/28 24/114.4
2014/0007382 A1 * 1/2014 Makki ..... A44B 1/42 156/92

* cited by examiner

BUTTON ATTACHMENT BY RESILIENT GATES TRAPPING MECHANISM

CROSS-REFERENCE TO RELATED APPLICATIONS

Not Applicable.

FEDERALLY SPONSORED RESEARCH

Not Applicable.

SEQUENCE LISTING OR PROGRAM

Not Applicable.

TECHNICAL FIELD

The present invention relates to Buttons Attachment to Garment Cloths.

PRIOR ART

Traditionally buttons are attached to garments by threads. However, sewing buttons is quite slow and laborious. Furthermore, threaded buttons tend to detach after intensive use. Hence, a faster and more robust button attachment method could yield a notable improvement. In our search we have found several inventions of button assemblies that were configured for fast button attachment but all of them are dissimilar to our invention both in their structures and in their principles of operation. Most, if not all of these attachment assemblies rely on some sort of metallic pedestal crimping in order to attach the button to the garment cloth. In U.S. Pat. No. 4,033,012 (Jul. 5, 1977) to Kramer et al. teaches a metallic button held by a metallic pedestal that is stapled to the garment cloth by a four legged metallic staple that is crimped to hold the pedestal. In U.S. Pat. No. 8,522,404 (Sep. 3, 2013) Matei teaches a button which can be tilted because it is attached to an elongated metallic shaft with ball attached at one end. The ball is housed in a ball bearing cavity included in the mounting base attached to the garment. In US 2005/0188510 (Sep. 1, 2005) Retamal teaches a button attached to an elongated serrated metal shaft which fits into a serrated metal nut attached to the garment. In U.S. Pat. No. 4,751,780 (Feb. 25, 1986) Fukuroi teaches a metal button which is attached to a mounting base by a crimped metal nail. In U.S. Pat. No. 4,512,063 (Apr. 23, 1985) Fukuroi teaches a metal button attachment to a base by a metal rivet. In U.S. Pat. No. 5,575,043 (Nov. 19, 1996) Candotti also teaches a metal button attachment to a base by a metal rivet. In U.S. Pat. No. 4,928,362 (May 29, 1990) Collas proposes to mount a metallic button on a metallic shank which is connected to a disk beneath the garment cloth. In U.S. Pat. No. 5,940,940 (Aug. 24, 1999) Tanikoshi teaches a button mounting by crimping a metal tubular rivet. In U.S. Pat. No. 5,975,398 (Nov. 2, 1999) Evans proposed attaching buttons to clothing by H shaped plastic studs which are inserted through the button holes into the clothing. In U.S. Pat. No. 9,820,520 (Nov. 21, 2017) Bolen teaches an attachment system with two parts one part attaches to the clothing side and the other part attaches to the button side and both parts are then coupled by a magnetic twist-lock mechanism. In U.S. Ser. No. 10/004,299 (Jun. 26, 2018) Maussen Teaches a tapered trapezoidal shape buttons which are connected to fabrics using sewing. IN U.S. Pat. No. 3,982,013 (Jul. 1, 1975) Gould teaches a button attachment using a rivet with long serrated shaft that protrudes from the clothing and is attached to a button with fitting aperture. In U.S. Pat. No. 8,938,861 (Jan. 27, 2015) McLendon teaches a removably attachable button using a pair of U-shaped flexible pins with small hooks at their ends, which are inserted through the clothing and through the button holes.

All the above inventions are entirely dissimilar to our invention.

BRIEF SUMMARY OF THE INVENTION

I have several goals in inventing and developing the Button Assembly of which some feasible embodiments are illustrated in FIGS. 1-9. The goals are:

1. To develop a Button Assembly which facilitates fast attachment of the buttoning structure to a garment cloth without any need for sewing, threads or metal crimping.
2. To design button assembly components which facilitate fast manual attachment without needing additional tools or machines.
3. To configure a buttoning structure which can be attached swiftly, firmly and permanently to garment cloths.
4. To design a retaining structure (i.e. an attachment structure to the garment cloth) for the button which can withstand strong pulling forces applied to the button without detachment.
5. To design a button assembly which could be manufactured inexpensively in mass production from common elastic materials such as plastics.
6. To develop a button assembly approach which facilitates creation of a large variety of colors and shapes of button appearances.
7. To configure a retaining structure that includes a trapping mechanism which exploits the resiliency of gates made of materials such as plastics to trap a terminal element which is attached to the buttoning structure. Thereby, robustly tying the button to the garment cloth.
8. To configure a button with replaceable ornamental caps.
9. To facilitate buttoning by integrating into the buttoning structure a spacer that introduces a gap between the button and the clothing.
10. To configure a cone that is temporarily attached to the bottom face of the terminal element and facilitates piercing of the garment cloth during manual attachment of the buttoning structure to the garment cloth.
11. To consider the option of drilling guiding apertures in the garment cloth to facilitate piercing of the garment cloth by the terminal element during manual attachment of the buttoning structure to the garment cloth.

In order to achieve some of the objectives listed above, our mechanism for button attachment to the garment cloth adopts the operational principle of mechanical trapping where the action of trapping is initiated by a forceful intrusion of a terminal element which bends a multiplicity of resilient flaps (i.e. a multiplicity of resilient gates—as in the Claims) which reside at the entrance of the retaining structure. Next, the bent resilient gating flaps are configured to be released when the terminal element is pushed further into the retaining structure, below the tips of the bended flaps. Next, the released flaps unbend due to their elasticity and end up resting on the pole above the terminal element, thus trapping the terminal element inside the aperture in the retaining structure.

The resilient gating flaps are initially bent by a forceful intrusion of a terminal element (i.e. a hemisphere or a cylinder which are attached to the end of a pole connected to the button). Initially, the downwards intrusion of the terminal element into the retaining structure's aperture pushes and bends downwards the resilient multiplicity of flaps that are attached at the upper opening of the retaining structure. Next, the trapping mechanism is triggered shut when the terminal element is pushed further downwards into the retaining structure, beyond the tips of the multiplicity of flaps. At that point, the multiplicity of flaps are released and unbend upwards due to their resiliency and end up resting diagonally on the pole above the terminal element. At this situation, the pole prevents further upwards unbending motion of the released multiplicity of flaps since the flaps ends are leaning diagonally on the pole. At this point, the multiplicity of flaps trap the terminal element inside the aperture in the retaining structure because they prevent the terminal element from retracting upwards. The button is also trapped since it is attached to the spacer which is attached to the pole which is attached to the trapped terminal element. While the multiplicity of flaps are diagonally resting on the pole above the terminal element's upper side, the flaps are prevented from turning upwards since their ends are diagonally resting on the pole. Hence, the multiplicity of resilient flaps are configured to prevent the terminal element from moving upwards thereby trapping the terminal element inside the retaining structure.

The manual attachment of the button to the garment cloth is performed as follows:

The button assembly is configured to be used for fast attachment of the button to the garment cloth by placing the retaining structure below the garment cloth such that the retaining structure's upper opening is facing a lower side of the garment cloth while placing the buttoning structure at an upper side of the garment cloth such that the terminal element is opposite the retaining structure's upper opening. Next, pushing downwards the buttoning structure from the upper side of the garment cloth is configured to pierce the garment cloth by the terminal element's lower side. Further pushing inserts the terminal element via the retaining structure's upper opening into the retaining part aperture which is situated at the lower side of the garment cloth beneath the retaining structure's upper opening. Inserting the terminal element downwards through the retaining part upper opening is configured to bend the multiplicity of flaps and to trap the terminal element inside the retaining part when the flaps unbend. At the completion of the terminal element insertion, it is trapped inside the retaining structure since it is situated beneath the multiplicity of flaps which are diagonally resting on the pole above the terminal element. At that point, the trapped terminal element which is attached to the buttoning structure, is configured to prevent detachment and separation of the buttoning structure from the retaining structure and also from the garment cloth. Thereby, completing the attachment of the button to the garment cloth by permanently attaching the buttoning structure to the garment cloth.

BRIEF DESCRIPTION OF THE DRAWINGS

In FIG. 6 the terminal element (in this case, the hemisphere) has already pierced the garment cloth.

In FIG. 7 all the collection components are already assembled in their final buttoning positions in which the hemisphere already has been inserted into the retaining structure.

DETAILED DESCRIPTION OF THE DRAWINGS

Figure 1:
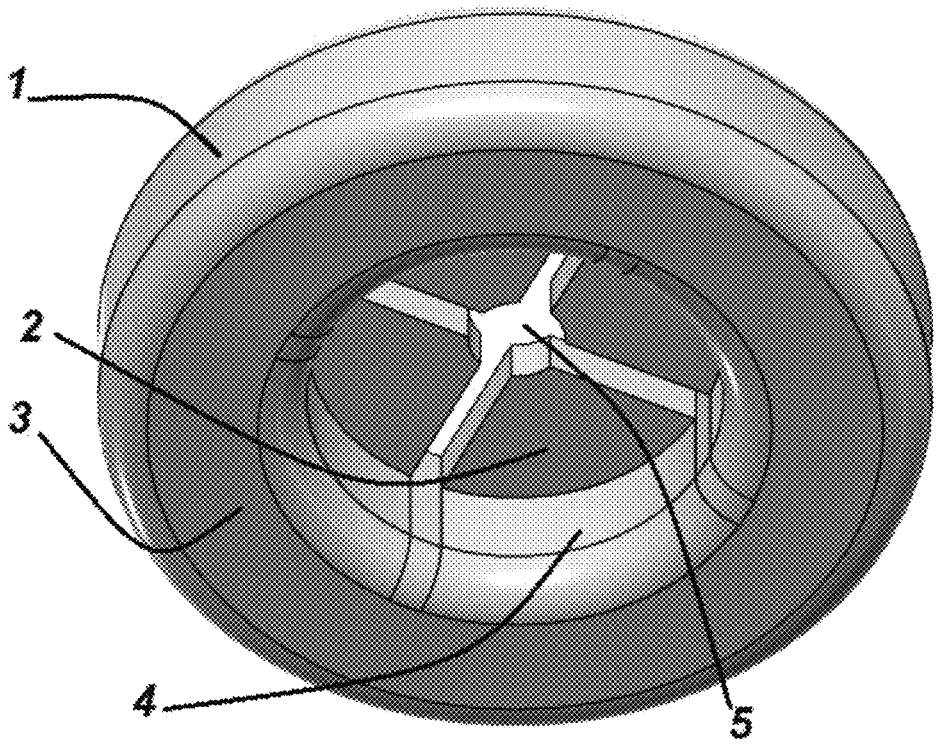
FIG. 1 displays a bottom view of an embodiment of the retaining structure in 3D isometric drawing.

FIG. 1 shows a bottom view of an embodiment of the retaining structure 1 in 3D isometric drawing. The retaining structure 1 is structured from a retaining part 3 with retaining part's upper circular opening and a lower circular opening 4. The retaining part's upper circular opening is covered entirely by an attached planar disk (planar plate in the claims) 2 which is divided by four radial slits centered at the center 5 of the planar disk. The planar disk 2 is made of a resilient material. The four slits divide the planar disk into four resilient gating flaps 2 (which correspond to the multiplicity of resilient flaps in the Claims). The slits are centered at the circular opening 5 drilled at the center of the planar disk. The inner space of the retaining part 3 is denoted by 4.

Figure 2:
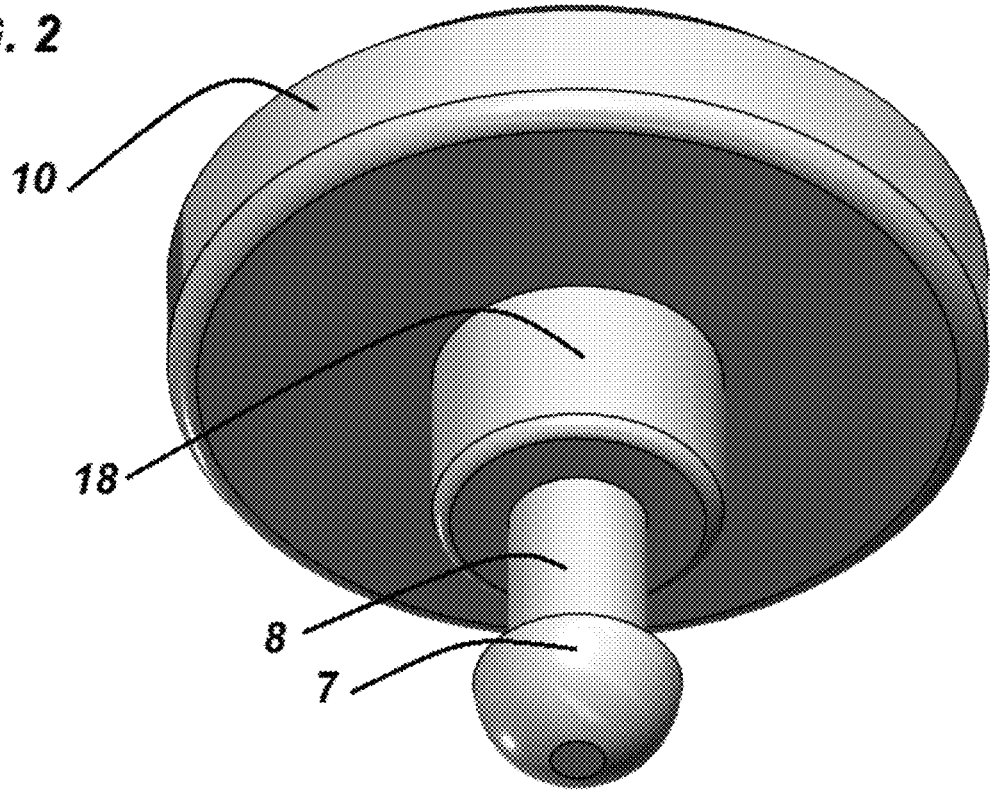
FIG. 2 Depicts in 3D isometric drawing a bottom view of an embodiment of the buttoning structure which includes the hemisphere connected to the pole at the pole's bottom end, the spacer attached to the top end of the pole and the button which is attached to the upper face of the spacer.

FIG. 2 Depicts in 3D isometric drawing a bottom view of an embodiment of the buttoning structure which includes the button 10. The buttoning structure comprises the terminal element 7 that is connected at the terminal element's upper side to the pole 8 at the pole's bottom end, the spacer's lower side 18 is attached to the top end of the pole 8 and the button 10 which is attached to the upper side of the spacer 18. The terminal element in FIG. 2 is shaped as a hemisphere in which the terminal element's upper face is shaped as a circular upper plane of the hemisphere and the terminal element's lower face is shaped as a hemispherical dome.

Figure 3:
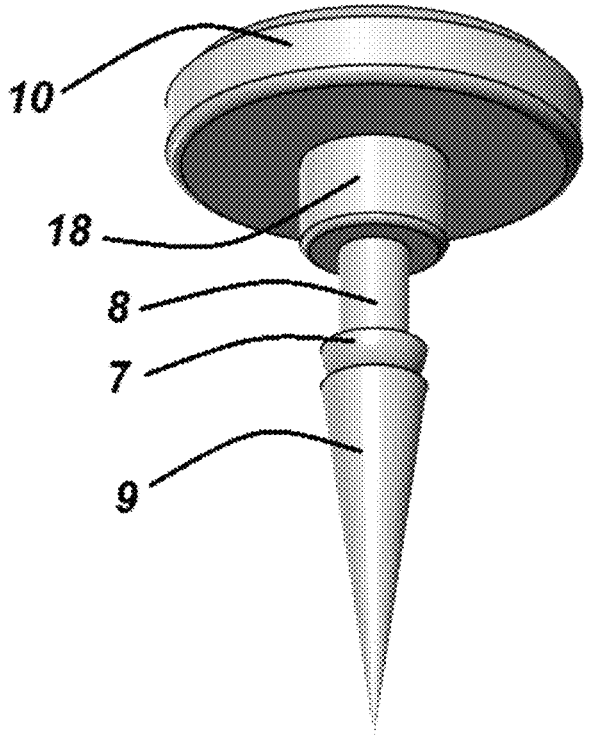
FIG. 3 Illustrates in 3D isometric drawing a bottom view of an embodiment of the buttoning structure which includes the hemisphere connected to the pole at the pole's bottom end, the spacer attached to the top end of the pole and the button which is attached to the upper face of the spacer. A piercing cone is temporarily attached to the bottom side of the hemispherical dome.

FIG. 3 Illustrates in 3D isometric drawing a bottom view of an embodiment of the buttoning structure 10-18-8-7 which includes the hemisphere 7 (the hemisphere 7 is the terminal element's shape in FIG. 3) that is attached to the pole 8 at the pole's bottom end, the spacer lower side 18 is attached to the top end of the pole 8 and the button 10 which is attached to the upper side of the spacer 18. A piercing cone 9 is attached to the bottom side of the hemispherical dome 7. The piercing cone 9 is configured to initialize piercing of garment to facilitate the piercing of the garment cloth by the attached hemisphere 7. The retaining structure 1 (not shown in FIG. 3) which is placed at the lower side of the garment's cloth 6 is configured to attach the buttoning structure 10-18-8-7 to the upper side of the garment cloth 6.

Figure 4:
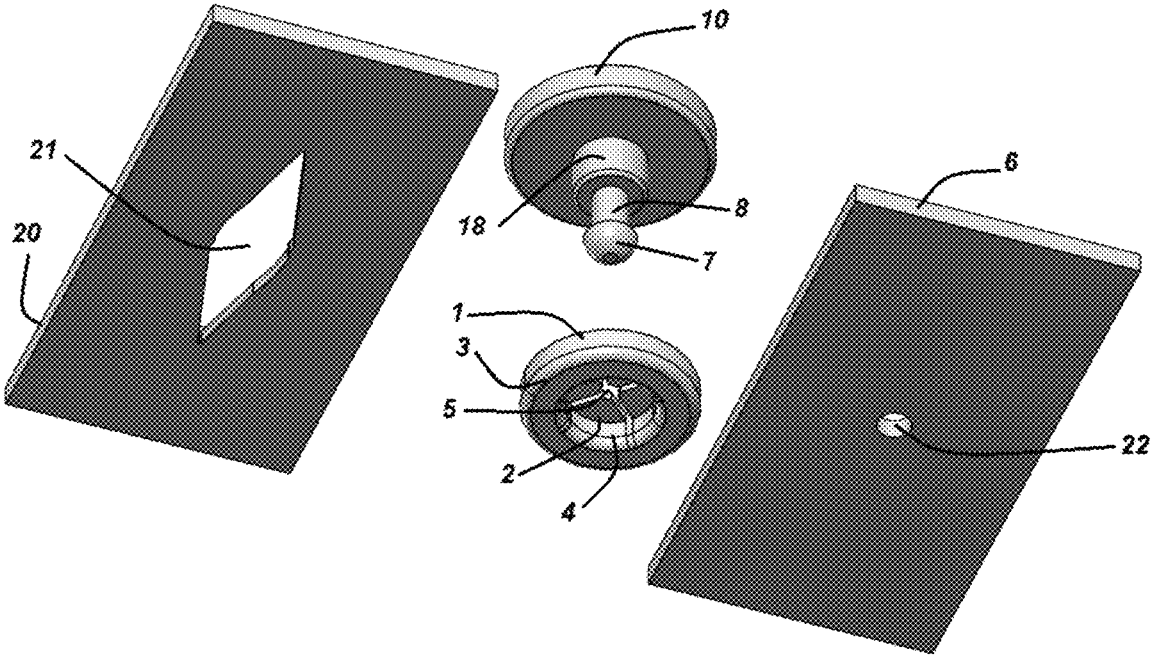
FIG. 4 illustrates in 3D isometric bottom view a collection of components required for a buttoning demonstration. The collection includes the buttoning structure, the retaining structure, the internal garment cloth and the external garment cloth which includes a buttoning slot.

FIG. 4 illustrates in 3D isometric bottom view a collection of components necessary for a buttoning demonstration. The collection includes the buttoning structure 7-8-18-10, the retaining structure 1-2-3-4-5, the internal garment cloth 6 and the external garment cloth 20 which includes a buttoning slot 21. The internal garment cloth 6 includes a guiding aperture 22 which is drilled in the internal garment cloth 6. The guiding aperture 22 is configured to facilitate piercing of the garment cloth by the terminal element's lower side.

The retaining structure 1 is structured from a retaining part 3 with retaining part's upper and lower circular openings. The retaining part's upper circular opening is entirely covered by an attached planar disk (equivalent to the planar plate in the claims) 2 which is divided by four radial slits into four resilient flaps 2. The four radial slits are centered at the circular opening 5 drilled at the center of the planar disk 2. The retaining part lower circular opening 4 is also shown.

Figure 5:
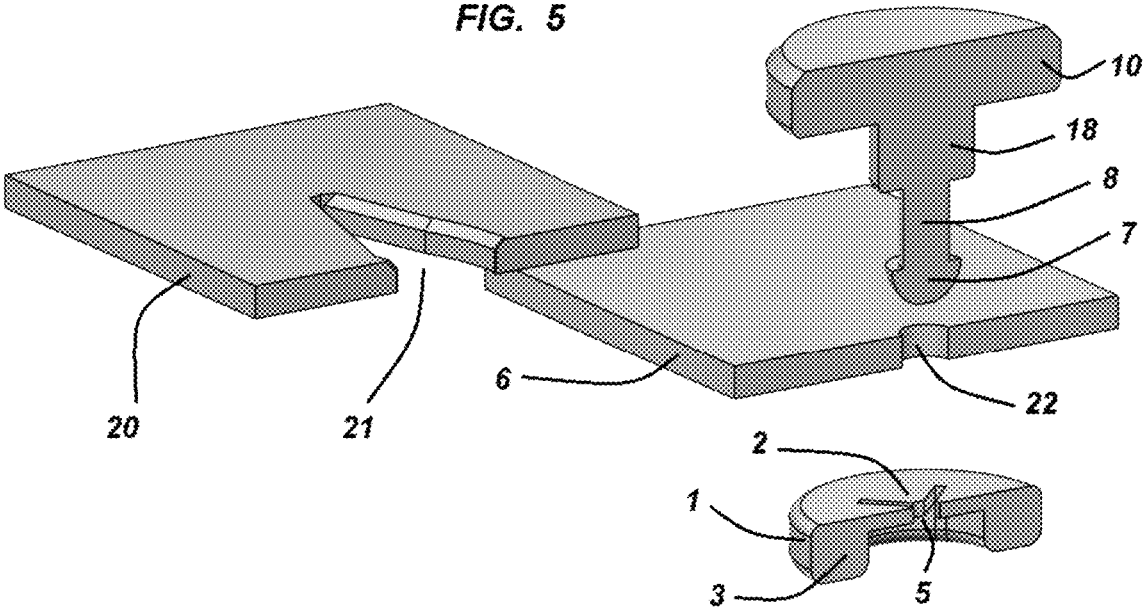
FIG. 5 illustrates in 3D isometric bottom view a cross section of the collection of components required for the buttoning demonstration. The collection includes the buttoning structure, the retaining structure, the internal garment cloth and the external garment cloth which includes a buttoning slot.

FIG. 5 illustrates a cross section of collection of parts depicted in FIG. 4. FIG. 5 illustrates the buttoning structure: 7-8-9-10 before the process of piercing the garment cloth 6. The hemisphere 7 (which is equivalent to the terminal element in claim 1) is pointing downwards and is situated at the position where the hemisphere 7 is preparing to pierce a cross sectional depiction of a piece of garment cloth 6. A cross section of the retaining structure 1-2-3-4-5 is illustrated underneath the garment cloth 6 and opposite to the hemisphere 7 which is generalized as the terminal element in the Claims. FIG. 5 actually illustrates the situation of the buttoning structure when the hemisphere 7 has already pierced the garment cloth 6 before entering into the retaining structure 1-2-3-4-5. A cross sectional view of the retaining structure 1-2-3-4-5 is also shown beneath the garment cloth 6. The retaining structure 1-2-3-4-5 is structured from a retaining part 3 with retaining part's upper and lower circular openings. The retaining part's upper circular opening is covered by an attached planar disk which is divided by four radial slits into four flaps 2 (which correspond to the multiplicity of resilient flaps mentioned in the Claims). The four radial slits are centered at the circular opening 5 drilled at the planar disk's center 5. The retaining part's lower circular opening 4 of the retaining part is also shown.

Figure 6:
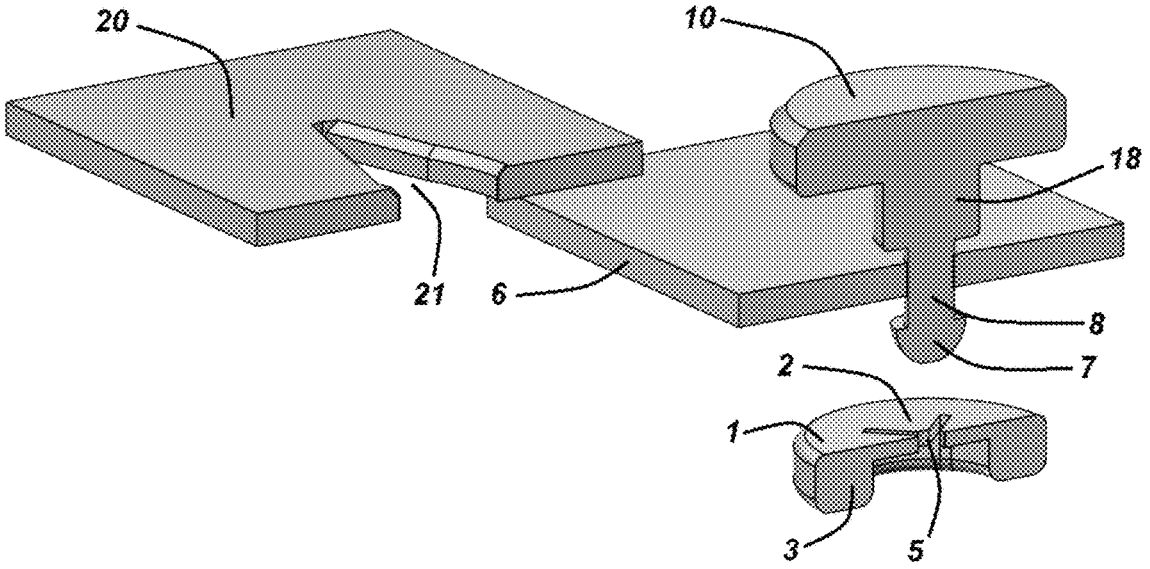
FIG. 6 illustrates in 3D isometric bottom view a cross section of the collection of components required for buttoning demonstration. The collection includes the buttoning structure, the retaining structure, the internal garment cloth and the external garment cloth which includes a buttoning slot.
Figure 7:
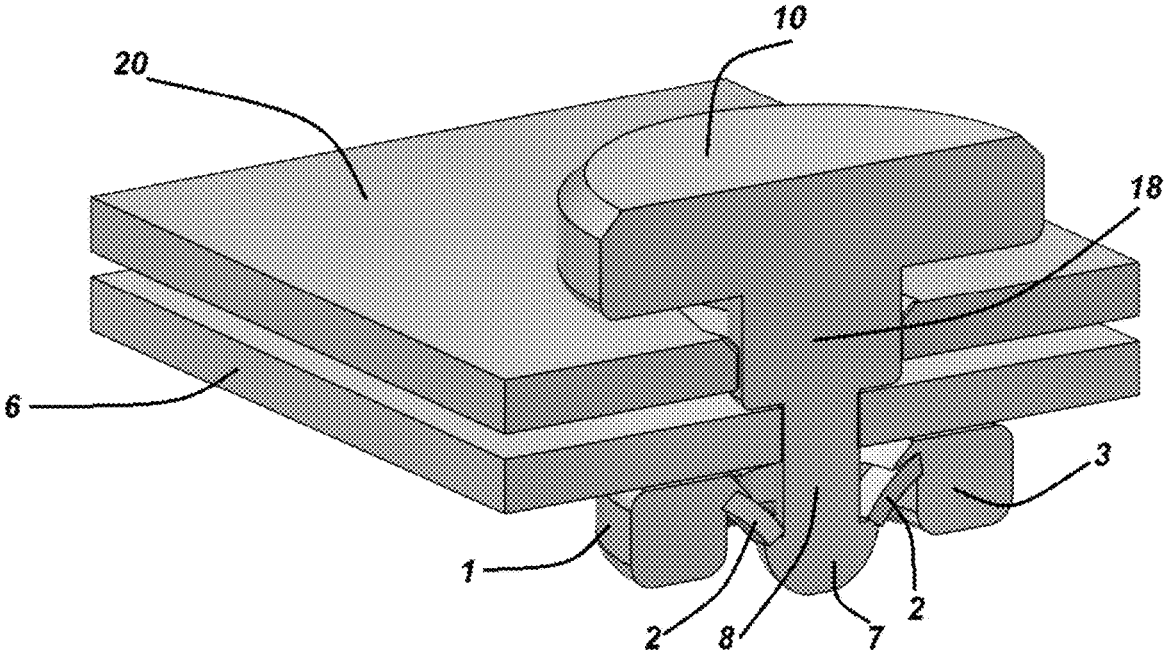
FIG. 7 Depicts in 3D isometric bottom view a cross section of the collection of components required for buttoning demonstration. The collection includes the buttoning structure, the retaining structure, the internal garment cloth and the external garment cloth which includes a buttoning slot.

FIG. 6 illustrates a cross sectional view of the collection of parts depicted in FIG. 4. FIG. 6 illustrates the buttoning structure: 7-8-9-10 while in the process of piercing the garment cloth 6. The hemisphere is 7 pointing downwards and situated at the position where the hemisphere 7 already pierced a cross sectional depiction of a piece of garment cloth 6. A cross section of the retaining structure 1-2-3-4-5 is illustrated underneath the garment cloth 6 and opposite to the hemisphere 7. The hemisphere 7 is also named as the terminal element in the Claims. FIG. 6 actually illustrates the situation of the buttoning structure after the hemisphere 7 has already pierced the garment cloth 6 before entering into the retaining structure 1-2-3-4-5. A cross sectional view of the retaining structure 1-2-3-4-5 is also shown beneath the garment cloth 6. The retaining structure 1-2-3-4-5 is structured from a retaining part 3 with retaining part's upper and lower circular openings. The retaining part's upper circular opening is covered by an attached planar disk which is divided by four radial slits into four flaps 2 (which correspond to the multiplicity of resilient flaps mentioned in the Claims). The four radial slits are centered at the circular opening 5 drilled at the planar disk's center 5. The retaining part lower circular opening 4 of the retaining part is also shown FIG. 7 illustrates a cross section of the same collection of parts depicted in FIG. 4. FIG. 7 illustrates the buttoning structure: 7-8-9-10 which already completed the process of piercing the garment cloth 6. The hemisphere is 7 pointing downwards and is situated at the position where the hemisphere 7 has already pierced the garment cloth 6, which is depicted as a cross section of a piece of the garment cloth 6. The hemisphere in FIG. 7 also has already entered the retaining structure 1-2-3-4-5 which is illustrated underneath the garment cloth 6. The resilient flaps 2 in FIG. 6 were bent already by the intrusion of the hemisphere 7. The flaps 2 in FIG. 7 are already unbent and resting diagonally on the pole 8 above the hemisphere 7 since the hemisphere 7 has already moved downwards below the flaps 2. The flaps 2 are trapping the hemisphere 7 since they are already unbent and resting diagonally on the pole 8 above the hemisphere 7 and preventing it from retracting upwards. The hemisphere 7 is generalized as the terminal element in the Claims.

Figure 8:
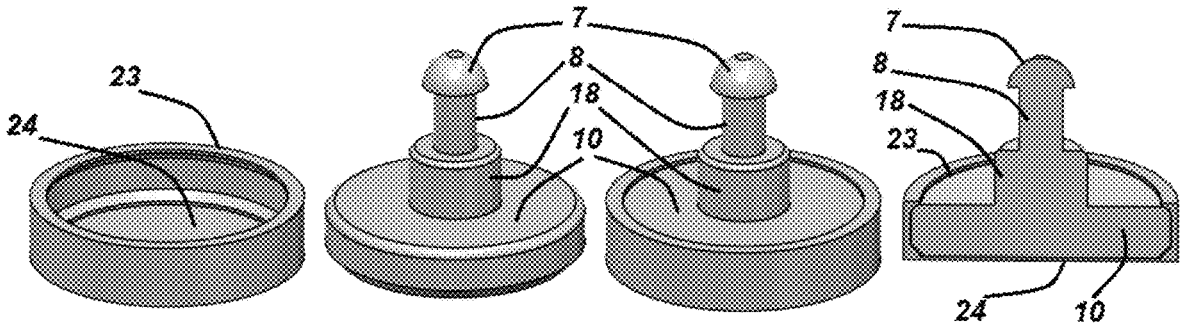
FIG. 8 Shows in an inverted upside-down view of 3D isometric drawing of three embodiments of the buttoning structure which include the hemisphere connected to the pole at the pole's bottom end, the spacer attached to the top end of the pole and the button which is attached to the upper face of the spacer. The drawing also depicts the ornamental cap in 3 positions. At the left-hand side, the buttoning structure and the cap are shown separately. At the center, the cap is installed on the button and in the right-hand side the buttoning structure and the installed cap are shown in a cross sectional view.

FIG. 8 Shows in 3D isometric drawing three top views of embodiments of the buttoning structure 7-8-18-10 which includes the hemisphere 7 which is connected to the pole 8 at the pole's bottom end. The spacer 18 is attached to the top end of the pole 8. Finally, the button 10 is attached to the upper face of the spacer 18. The drawing also depicts the ornamental cap 23 in 3 positions. At the left-hand side of FIG. 7, the buttoning structure 7-8-18-10 and the cap 23 are shown separately. At the center, the cap 23 is installed on the button 10 and at the right-hand side the buttoning structure 7-8-18-10 and the installed cap 23 are shown in a cross-sectional view. The ornamental face 24 of the cap 23 is also shown in FIG. 7.

Figure 9:
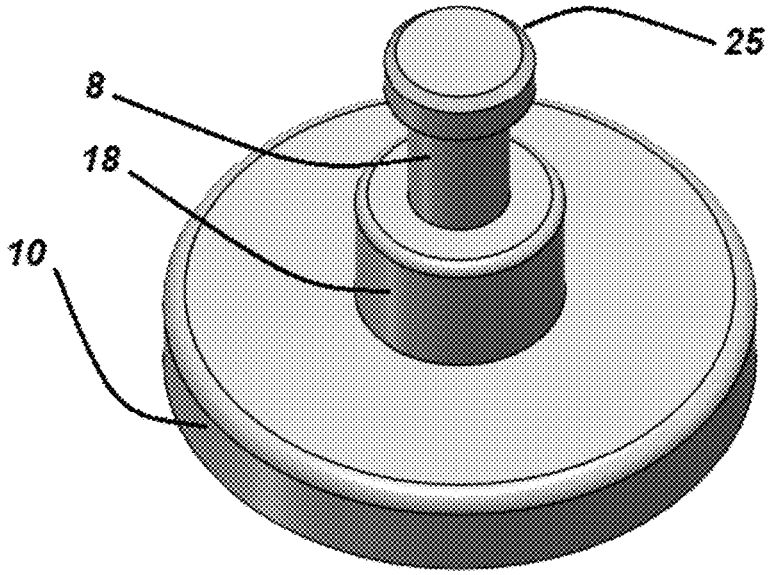
FIG. 9 Illustrates in an upside-down view of 3D isometric drawing a top view of an embodiment of the buttoning structure which includes a cylinder (cylindrical plate) which serves here as the terminal element. The cylinder is connected to the pole at the pole's bottom end, the spacer attached to the top end of the pole and the button which is attached to the upper face of the spacer.

FIG. 9 Illustrates in 3D isometric drawing a top view of an embodiment of the buttoning structure 25-8-18-10 which includes a cylinder 25 (which is generalized as the terminal element in the Claims and named as a cylindrical plate) which is connected to the pole 8 at the pole's bottom end, the spacer 18 is attached to the top end of the pole 8 and the button 10 which is attached to the upper face of the spacer 18.

What is claimed is:

1. A button assembly configured for a button attachment on a garment cloth;

wherein the button assembly comprises a buttoning structure and a retaining structure;

wherein the buttoning structure comprises: a spacer, a pole and a terminal element;

wherein the button includes a button's lower face and a button's upper face;

wherein the spacer includes a spacer's upper side and a spacer's lower side;

wherein the pole includes a pole's top end and a pole's bottom end;

wherein the terminal element includes a terminal element's upper side and a terminal element's lower side;

wherein the button's lower face is attached to the spacer's upper side;

wherein the spacer's lower side is attached to the pole's top end;

wherein the pole's bottom end is attached to the terminal element's upper side;

wherein the retaining structure comprises an aperture which houses a trapping mechanism;

wherein the aperture also includes an upper opening;

wherein the trapping mechanism includes a multiplicity of resilient flaps which is configured to facilitate an unidirectional downwards translation of the terminal element via the upper opening into the aperture;

wherein the terminal element is configured to move downwards and to push down the multiplicity of resilient flaps;

wherein the multiplicity of resilient flaps is configured to open the upper opening and to facilitate the unidirectional downwards translation of the terminal element via the upper opening into the aperture;

after the unidirectional downwards translation of the terminal element via the upper opening into the aperture is completed, the multiplicity of resilient flaps is configured to trap the terminal element within the aperture and to prevent any translation upwards of the terminal element from the aperture;

the button assembly is configured to facilitate the button attachment to the garment cloth by placing the retaining structure below the garment cloth such that the upper opening is facing a lower side of the garment cloth while placing the buttoning structure above the garment cloth facing an upper side of the garment cloth such that the terminal element is opposite the upper opening;

next, pushing downwards the terminal element from the upper side of the garment cloth is configured to pierce the garment cloth by the terminal element's lower side and also is configured to insert the terminal element via the upper opening downwards into the aperture;

wherein inserting downwards the terminal element into the upper opening is configured to push open the multiplicity of resilient flaps while facilitating the unidirectional downwards translation of the terminal element via the upper opening into the aperture;

next, following the downwards insertion of the terminal element into the aperture, the multiplicity of resilient flaps is configured to trap the terminal element in the aperture by preventing any translation upwards of the terminal element from the aperture;

the multiplicity of resilient flaps also is configured to prevent any translation upwards of the buttoning structure and the button, which both are connected to terminal element;

wherein, trapping the terminal element which is attached to the buttoning structure, is configured to prevent the buttoning structure from moving upwards, away from the retaining structure and the garment cloth;

wherein, trapping the terminal element is configured to attach the button to the retaining structure and to the garment cloth.

2. The button assembly of claim 1, wherein the retaining structure includes a planar plate made of a resilient material;

wherein the upper opening has an upper rim;

wherein the upper rim is attached to the planar plate which is configured to be large enough to cover entirely the upper opening;

wherein the trapping mechanism includes the multiplicity of resilient flaps which is manufactured from the planar plate which is divided into a multiplicity of resilient flaps by a multiplicity of radial slits which are centered at an upper opening's center;

the multiplicity of resilient flaps is configured to facilitate the unidirectional downwards translation of the terminal element via the upper opening into the aperture by bending and turning downwards when the terminal element is pushed downwards via the upper opening;

when the terminal element is pushed further downwards into a position below the multiplicity of resilient flaps, the multiplicity of resilient flaps are configured to be released and are configured to unbend while turning upwards due to their resiliency; the multiplicity of resilient flaps are configured to end their unbending motion by turning upwards until they are stopped by diagonally resting on the pole above the terminal element's upper side;

while the multiplicity of resilient flaps is diagonally resting on the pole above the terminal element's upper side, they are configured to prevent the terminal element from moving upwards, thereby trapping the terminal element inside the aperture and preventing any upwards translation of the terminal element from the aperture;

the button assembly is configured to facilitate the button attachment to the garment cloth by placing the retaining structure below the garment cloth such that the upper opening is facing the lower side of the garment cloth while placing the buttoning structure above the garment cloth facing the upper side of the garment cloth such that the terminal element is opposite the upper opening;

next, pushing downwards the terminal element from the upper side of the garment cloth is configured to pierce the garment cloth by the terminal element's lower side; wherein pushing further downwards the terminal element is configured to insert the terminal element via the upper opening downwards into the aperture;

next, following the downwards insertion of the terminal element into the aperture, the multiplicity of resilient flaps is configured to trap the terminal element in the aperture by preventing any translation upwards of the terminal element from the aperture;

the multiplicity of resilient flaps also is configured to prevent any translation upwards of the buttoning structure and the button, which both are connected to the terminal element;

wherein, trapping the terminal element which is attached to the buttoning structure, is configured to prevent the buttoning structure from moving upwards, away from the retaining structure and the garment cloth;

wherein, trapping the terminal element is configured to attach the button to the retaining structure and to the garment cloth.

3. The button assembly of claim 1, wherein the terminal element is configured to have a shape of a hemisphere;

wherein the terminal element's upper side is shaped as a circular upper plane of the hemisphere;

the terminal element's lower side is shaped as a hemispherical dome; wherein the pole's bottom end is attached to the circular upper plane.

4. The button assembly of claim 3, wherein a minimal width of the upper opening is configured to be larger than a diameter of the circular upper plane of the hemisphere by at least a thickness of the planar plate.

5. The button assembly of claim 3, wherein the pole is configured to be cylindrical; wherein a radius of a pole's circular cross section is configured to be smaller than a radius of the circular upper plane of the hemisphere by at least a thickness of the planar plate.

6. The button assembly of claim 5, wherein the spacer is configured to have a spacer's cylindrical shape with a spacer's circular cross section; wherein a radius of the spacer's circular cross section is configured to be larger than the radius of the pole's circular cross section; wherein a height of the spacer's cylindrical shape is configured to be larger than a thickness of the garment cloth; thereby sufficiently spacing the button to facilitate buttoning.

7. The button assembly of claim 6, wherein the button is configured to have a cylindrical shape; wherein a radius of a button's circular cross section is configured to be larger than the radius of the spacer's circular cross section.

8. The button assembly of claim 1, wherein the terminal element is configured to have a shape of a cylindrical plate; wherein the terminal element's upper side is shaped as a circular upper plane of the cylindrical plate and a terminal element's lower side is shaped as a circular lower plane of the cylindrical plate; wherein the bottom end of the pole is attached to the circular upper plane of the cylindrical plate.

9. The button assembly of claim 8, wherein a minimal width of the retaining structure's upper opening is configured to be larger than a radius of the circular upper plane of the cylindrical plate by at least a thickness of the planar plate.

10. The button assembly of claim 8, wherein the pole is configured to be cylindrical; wherein a radius of a pole's circular cross section is configured to be smaller than a radius of the circular upper plane of the cylindrical plate by at least a thickness of the planar plate.

11. The button assembly of claim 1, wherein a piercing cone which is configured to facilitate piercing of the garment cloth when pushed through the garment cloth; wherein a flat base of the piercing cone is configured to be temporarily connected to the terminal element's lower side; wherein a pointed side of the piercing cone is configured to point downwards; the piercing cone is configured to be disconnected and removed after piercing.

12. The button assembly of claim 1, wherein the button's upper face is configured to be ornamentally engraved or sculpted.

13. The button assembly of claim 1, wherein the button is configured to have a cylindrical shape which the button's upper face is a circular upper plane of the button; wherein the circular upper plane of the button is configured to fit snuggly inside a circular cap; wherein the circular cap is configured to be made of an elastic material which facilitates installment on top of the circular upper plane of the button; the circular cap is made of the elastic material which also facilitates removal of the circular cap from the top of the circular upper plane of the button;

wherein the circular cap is configured to have a cap's upper face; wherein the cap's upper face is ornamentally engraved or sculpted.

14. The button assembly of claim 1, wherein a guiding aperture is drilled in the garment cloth situated at a desired location for the button attachment; wherein prior to piercing of the garment cloth, the guiding aperture is positioned opposite to the terminal element; wherein the guiding aperture is configured to facilitate piercing the garment cloth by the terminal element's lower side.

15. The button assembly of claim 1, wherein the retaining structure comprises a toroid and a planar plate;

wherein the retaining structure is configured to have a toroidal shape.

16. A button assembly configured for a button attachment on a garment cloth;

wherein the button assembly comprises a buttoning structure and a retaining structure;

wherein the buttoning structure comprises: a spacer, a pole and a terminal element;

wherein the button includes a button's lower face and a button's upper face;

wherein the spacer includes a spacer's upper side and a spacer's lower side;

wherein the pole includes a pole's top end and a pole's bottom end;

wherein the terminal element includes a terminal element's upper side and a terminal element's lower side;

wherein the button's lower face is attached to the spacer's upper side;

wherein the spacer's lower side is attached to the pole's top end;

wherein the pole's bottom end is attached to the terminal element's upper side;

wherein the retaining structure comprises an aperture which houses a trapping mechanism;

wherein the aperture also includes an upper opening;

wherein the trapping mechanism includes a resilient gate which is configured to facilitate an unidirectional downwards translation of the terminal element via the upper opening into the aperture;

wherein the terminal element is configured to move downwards and to push down the resilient gate;

wherein the resilient gate is configured to open the upper opening and to facilitate the unidirectional downwards translation of the terminal element via the upper opening into the aperture;

after the unidirectional downwards translation of the terminal element via the upper opening into the aperture is completed, the resilient gate is configured to trap the terminal element within the aperture and to prevent any translation upwards of the terminal element from the aperture;

the button assembly is configured to facilitate the button attachment to the garment cloth by placing the retaining structure below the garment cloth such that the upper opening is facing a lower side of the garment cloth while placing the buttoning structure above the garment cloth facing an upper side of the garment cloth such that the terminal element is opposite the upper opening;

next, pushing downwards the terminal element from the upper side of the garment cloth is configured to pierce the garment cloth by the terminal element's lower side and also is configured to insert the terminal element via the upper opening downwards into the aperture;

wherein inserting downwards the terminal element into the upper opening is configured to push open the resilient gate while facilitating the unidirectional downwards translation of the terminal element via the upper opening into the aperture;

next, following the downwards insertion of the terminal element into the aperture, the resilient gate is configured to trap the terminal element in the aperture by preventing any translation upwards of the terminal element from the aperture;

the resilient gate also is configured to prevent any translation upwards of the buttoning structure and the button, which both are connected to the terminal element;

wherein, trapping the terminal element which is attached to the buttoning structure, is configured to prevent the buttoning structure from moving upwards, away from the retaining structure and the garment cloth;

wherein, trapping the terminal element is configured to attach the button to the retaining structure and to the garment cloth.

* * * * *